US008777539B2

(12) United States Patent
Rizzuti et al.

(10) Patent No.: US 8,777,539 B2
(45) Date of Patent: Jul. 15, 2014

(54) LOWER SEALING VALVE UNIT FOR A BLAST FURNACE TOP CHARGING SYSTEM

(75) Inventors: Ettore Rizzuti, Bascharage (LU); Jeannot Loutsch, Mondercange (LU)

(73) Assignee: Paul Wurth S.A., Luxembourg (LU)

( * ) Notice: Subject to any disclaimer, the term of this patent is extended or adjusted under 35 U.S.C. 154(b) by 130 days.

(21) Appl. No.: 13/144,305

(22) PCT Filed: Jan. 13, 2010

(86) PCT No.: PCT/EP2010/050323

§ 371 (c)(1),
(2), (4) Date: Jul. 13, 2011

(87) PCT Pub. No.: WO2010/081810

PCT Pub. Date: Jul. 22, 2010

(65) Prior Publication Data

US 2011/0274519 A1 Nov. 10, 2011

(30) Foreign Application Priority Data

Jan. 14, 2009 (LU) ..... 91511

(51) Int. Cl.
*F23K 3/06* (2006.01)
*F27B 1/20* (2006.01)
*F27D 3/10* (2006.01)

(52) U.S. Cl.
USPC ..... 414/206; 222/506; 222/545; 414/200

(58) Field of Classification Search
CPC ..... F23K 3/06; F27B 1/20; F27D 3/10
USPC ..... 414/199, 200, 201, 202, 206
See application file for complete search history.

(56) References Cited

U.S. PATENT DOCUMENTS

| | | | | |
|---|---|---|---|---|
| 3,955,693 | A | 5/1976 | Legille et al. | |
| 4,074,835 | A * | 2/1978 | Legille et al. | 414/200 |
| 4,089,429 | A * | 5/1978 | Stock et al. | 414/200 |
| 4,514,129 | A * | 4/1985 | Legille et al. | 414/200 |
| 4,570,900 | A * | 2/1986 | Lonardi et al. | 251/58 |
| 4,755,095 | A * | 7/1988 | Mailliet et al. | 414/200 |
| 4,821,998 | A * | 4/1989 | Legille et al. | 251/58 |
| 6,481,946 | B1 * | 11/2002 | Lonardi et al. | 414/299 |
| 8,092,136 | B2 * | 1/2012 | Lonardi et al. | 414/206 |

FOREIGN PATENT DOCUMENTS

| | | | |
|---|---|---|---|
| EP | 1811045 | A1 | 7/2007 |
| JP | 55044577 | A | 3/1980 |

OTHER PUBLICATIONS

International Search Report PCT/EP2010/050323; Dated Feb. 25, 2010.

* cited by examiner

*Primary Examiner* — James Keenan
(74) *Attorney, Agent, or Firm* — Cantor Colburn LLP

(57) ABSTRACT

A lower sealing valve unit for a charging system of a shaft furnace includes a housing having a pair of inlets and at least one outlet; a valve seat associated with each inlet; and a flap associated with each valve seat and adapted for, in a closed position, engaging the valve seat to sealingly close the inlet, each flap being supported by a pivotable shaft allowing displacement between the closed position and an open position off the associated valve seat, where a common structure, mounted to one side of the housing, includes a pair of drive mechanisms, each connected to one of the pivotable shafts for independent actuation thereof, the shafts passing coaxially though the housing side and being supported by the common structure.

13 Claims, 2 Drawing Sheets

LOWER SEALING VALVE UNIT FOR A BLAST FURNACE TOP CHARGING SYSTEM

TECHNICAL FIELD

The present invention generally relates to a charging system for a blast furnace, and more specifically to a lower sealing valve unit as suitable e.g. for a Bell-Less Top™ charging system.

BACKGROUND

Bell-Less Top™ charging systems have found widespread use in blast furnaces around the world. They commonly comprise a rotary distribution device equipped with a distribution chute, which is rotatable about the vertical central axis of the furnace and pivotable about a horizontal axis perpendicular to the central axis. In a typical so-called "parallel hopper top" configuration adapted for allowing quasi-continuous charging of bulk material, two or three storage hoppers are installed above the rotary distribution device with distribution chute. In a manner known per se, the hoppers serve as storage bins for bulk material to be distributed by the distribution device and as pressure locks avoiding the loss of pressure in the blast furnace by means upper and lower sealing valves.

EP 1 811 045 presents a modern design of a blast furnace equipped with a Bell-Less Top™ charging system. Two charging hoppers are installed in "parallel hopper top" configuration above a distribution device (with rotatable and pivotable chute), itself arranged as top closure of the blast furnace throat. Each storage hopper has a material gate valve at its lower end that is located inside a respective material gate housing. The respective material gate valves comprise a cylindrically curved shutter element moveable along the discharge opening of a chute member that enables precise metering of bulk material by controlling the valve opening area. Operation of each shutter element is achieved by means of a respective, externally mounted actuator.

Below, a lower sealing valve housing is arranged between the material gate housings and the distribution device. This housing comprises one inlet per storage hopper to which a respective sealing valve (with flap and valve seat) is associated. Each flap is pivotable by means of an arm about a horizontal axis to be moved in and out of sealing engagement with the valve seat. Each flap arm is also connected to a respective actuator outside the sealing valve housing.

As it will be understood by those skilled in the art, this region of the blast furnace facility in-between the hopper bottoms and the blast furnace throat is densely equipped, featuring the material gates and sealing valves, corresponding actuators, as well as the rotary distribution device with its drive mechanism. From the design point of view, this region comprising numerous moving elements with their actuating mechanisms and mounting supports is critical in terms of reliability, manufacturing costs, accessibility, mounting, tolerances etc. . . . .

Hence, it would be desirable to modify the construction of this lower region of the charging system to simplify its structure, permitting amongst others to save manufacturing costs.

BRIEF SUMMARY OF THE INVENTION

The present invention provides a lower sealing valve unit of modified design. The lower sealing valve unit according to the present invention comprises:

a housing having a pair of inlets and at least one outlet;

a valve seat associated with each inlet;

a flap associated with each valve seat and adapted for, in a closed position, engaging said valve seat to sealingly close said inlet, each flap being supported by a pivotable shaft allowing displacement between said closed position and an open position off the associated valve seat.

According to an important aspect of the invention, a common structure is mounted to one side of the housing and comprises a pair of driving mechanisms, each connected to one of the pivotable shafts for independent actuation thereof. Furthermore, the shafts are arranged to coaxially pass through the same housing side and are supported by the common structure.

Hence, the present invention provides for a simplified mounting and actuation of the lower sealing valves in a two-hopper charging system, due namely to the use of a coaxial shaft arrangement for pivoting the flaps, which traverses the housing wall at a single location to be supported by the common support structure, on a same side of the housing. Employing a single, common support structure for both sealing flaps clearly reduces manufacturing costs.

The number of components arranged in this region below the storage hoppers are also reduced, which allows for a more compact design of the blast furnace charging system.

The coaxial shaft arrangement is preferably formed by one hollow pivotable shaft in which the other pivotable shaft is concentrically arranged to be freely rotatable. The inner shaft may protrude at both ends of the hollow shaft for ease of connection.

In one embodiment, the common structure comprises a mounting flange that supports the coaxial shaft arrangement and is fixed to the outside side-wall of the housing and centred with respect to a corresponding opening therein. Advantageously the mounting flange comprises a centering member having a cross-sectional shape matching the cross-section of the opening in the housing.

Each flap is preferably supported by an arm, which is connected to the respective pivotable shaft and rotationally integral therewith.

Conventionally, the valve seats may be attached at the extremity of a respective sleeve projecting from each inlets inside the housing. This allows for an offset sealing of the inlets that facilitates the arrangements of the flap support and drive means.

In one embodiment, each drive mechanism comprises a linear actuator coupled to its respective shaft via a respective lever. Each lever is rotationally integral with the pivotable shaft and hinged to the actuating member of the linear actuator. The linear actuators are pivotally supported in a respective cradle affixed to the mounting flange.

Such cradle preferably comprises a pair of parallel brackets fixed to an extension of the mounting flange, the brackets being provided in their top edge with a vertical slot. The linear actuators are then provided at their periphery with a pair of diametrically opposite radial pins (trunnions) that fit into the vertical slots.

For a sealed pivoting of shafts, a stuffing box may be arranged about the coaxial shaft arrangement in the region of the mounting flange.

The present invention provides a lower sealing valve unit for a top charging system, especially of the Bell Less Top™ type, of a blast/shaft furnace equipped that has many advantageous aspects. A common structure with coaxial shaft arrangement of simple structure can be used for controlling the lower sealing valves of a set of two storage hoppers. This particular mounting using a single mounting flange for two lower sealing valves reduces the number of components in the lower region of the hoppers, and thus facilitates accessibility and permits improving compactness. There are also other benefits:

- this design allows lowering the height and reducing the size of the housing, which also implies a more centred flow of charge material in the lower sealing valve housing;
- a single mounting flange at one side reduces manufacturing costs of such cast piece requiring machining and finishing as well as precise positioning/alignment in the housing side-wall;
- the support and drive mechanisms of the flaps being organised on a common support, it is easily accessible and dismountable;
- the common structure being installed on one side of the housing, it is easier to install it so that it does not interfere with the other mechanisms in this region of the top charging system, e.g. the planetary gearbox of the rotary distribution device.

BRIEF DESCRIPTION OF THE DRAWINGS

The present invention will now be described, by way of example, with reference to the accompanying drawings, in which.

DETAILED DESCRIPTION

Figure 1:
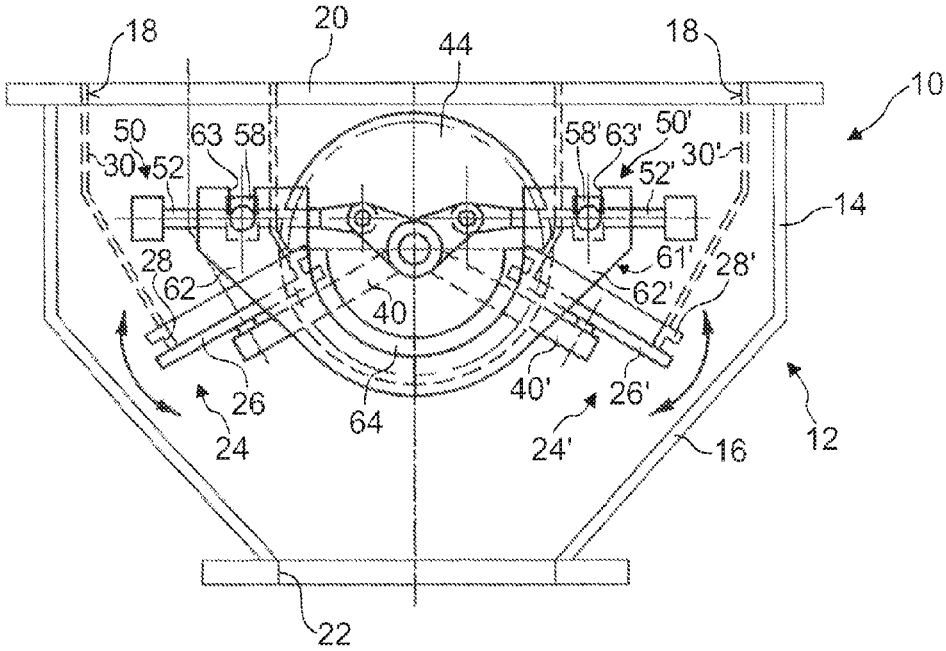
FIG. 1: is a principle drawing of a preferred embodiment of the present lower sealing valve unit, with the valves closed.
Figure 2:
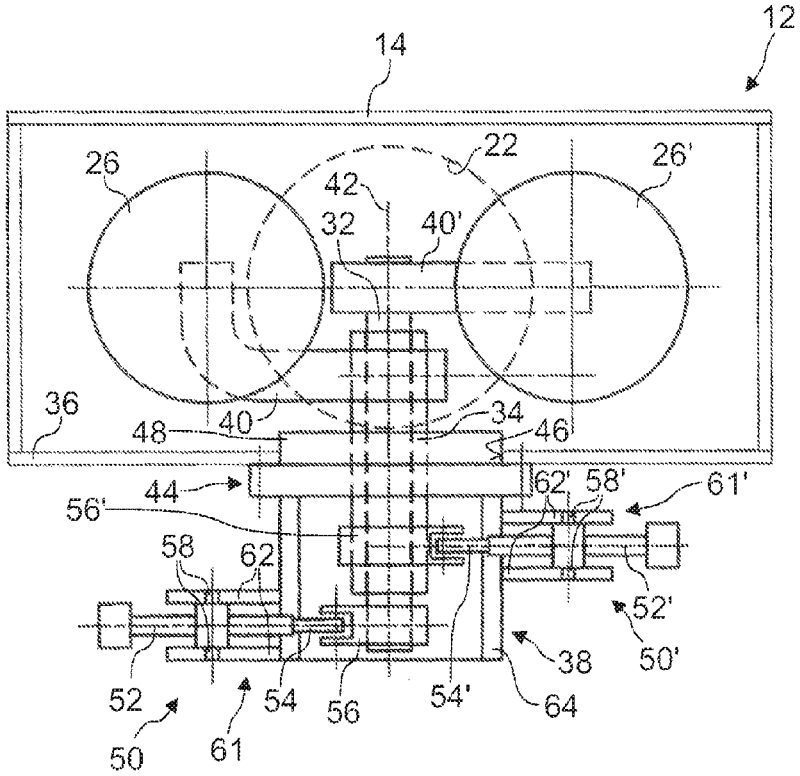
FIG. 2: is a top view of the embodiment of FIG. 1, without the cover portion.

FIG. 1 schematically illustrates, in a side view, a preferred embodiment of a lower sealing valve unit 10 for a charging system of a shaft furnace. The present unit 10 finds particular application in a Bell-Less Top™ charging system for a blast furnace. As it is well known, a lower sealing valve unit is used, in Bell-Less Top™ systems, to isolate the bottom region of the storage hoppers from the top of the blast furnace in order to avoid pressure losses. The present lower sealing valve unit 10 is designed for use with a charging installation comprising two hoppers in a "parallel hopper top" configuration, and will typically be arranged between the region of the material gates at the hoppers bottoms and the conventional rotary distribution device closing the blast/shaft furnace throat. The present lower sealing valve unit 10 can for example be used in place of the one used in the Bell-Less Top™ system shown in FIG. 2 or 4 of EP 1 811 045.

Referring now more specifically to the embodiment of FIG. 1, the present lower sealing valve unit 10 comprises a housing 12 of conventional shape, i.e. it includes a rectangular top part 14 and a funnel shaped bottom part 16 (seen in vertical cross-section), preferably connected to one another by welding. This housing 12 defines a closed volume and has a pair of inlets 18 provided in a cover 20 of the top part 14, each in communication with a respective storage hopper (not shown) of the charging system through a respective material gate (not shown). An outlet 22 is provided at the bottom of the lower, funnel shaped part 16, through which bulk material falls into the rotary distribution device (not shown). The lower sealing valve housing 12 is conventionally fixed to the support structure (not shown) of the top charging system that further holds the storage hoppers above the blast furnace. As it is known in the art, compensators, e.g. bellows compensators, (not shown) can be used to connect the inlets to the respective material gates (material gate housings) and to connect the housing outlet 22 to the distribution device.

The inlets 18 in the cover 20 of the housing 12 can be selectively and independently closed by means of a pair of sealing valves 24, 24' arranged in the housing top region, each valve comprising a flap 26, 26' and associated valve seat 28, 28'. The valve seats 28, 28' are each attached in a sleeve 30, 30' projecting downwardly from the inlets 18 into the housing 12. Each flap 26, 26' is adapted for engaging its respective valve seat 28, 28' to sealingly close the latter in a closed position, and is supported by a pivotable shaft 32, respectively 34, for its actuation between the closed position (FIG. 1) and an open position off the valve seat 28, resp. 28'.

It shall be appreciated that the shafts 32 and 34 are arranged in a coaxial manner to pass through the same housing side-wall 36 and are supported by a common structure, generally indicated 38, mounted to the side-wall 36 and further supporting drive mechanisms for the shafts 32, 34. As for the present coaxial shaft arrangement, shaft 34 is hollow while the other shaft 32 is concentrically arranged inside hollow shaft 34 and protrudes at both ends thereof for connection purposes. Although not shown, the inner shaft 32 is advantageously supported by one, two or more bearings (e.g. roller bearings) inside the hollow shaft 34.

As can be seen in the Figs., each flap 26, 26' is attached at one end of an arm 40, resp. 40', which has its other end fixedly connected to a respective pivotable shaft 34, resp. 32, so as to be integral in rotation therewith. Hence, the shafts 32 and 34 are independently pivotable/rotatable about a common axis 42 and their respective rotation allows moving the flaps 26, 26' in and out of sealing engagement with the valve seats 28, 28'.

Referring more specifically to the common structure 38, it comprises a mounting flange 44 that rotatably supports the coaxial shaft arrangement. Typically it may comprise one or more bearings (e.g. roller bearings) that permit the pivoting of the outer shaft 34 about itself. This mounting flange 44 is fixed (e.g. screwed) to the outer side of side-wall 36 and centered with respect to a corresponding opening 46 therein. Advantageously the mounting flange 44 comprises a centering member 48 that has a cross-sectional shape matching the cross-section of opening 46 in side-wall 36. Typically the centering member 48 is circular and its outer diameter corresponds to the diameter of opening 46.

Opening and closing of the lower sealing valves 24, 24' can be independently operated by a pair of drive mechanisms 50, 50' that are each associated to a respective flap 26, 26'. In the present embodiment, each drive mechanism 50, 50' comprises a linear actuator 52, 52', e.g. a hydraulic or screw jack, having its actuating rod 54, 54' coupled to a respective shaft 32, 34 by means of a lever 56, 56'. Each lever 56, resp. 56', is rigidly coupled to its respective shaft 32, 34 so as to be integral in rotation therewith, while at its opposite end it is hingedly coupled to the actuating rod 54, 54' of the linear actuator 52, 52'.

The linear actuators 52, 52' are each supported in a respective cradle 61, 61' comprising a pair of parallel brackets 62, 62' extending perpendicularly to the shafts 32, 34 and having each a vertical slot 63, 63' in their upper edge. A pivotal mounting of the linear actuators 52, 52' is achieved by means of trunnions 58, 58' fitted over the actuator's body that fit into the slots 63, 63'. As can be better seen in FIG. 2, the brackets 62, 62' are fixed by their lower parts to a half-tubular extension 64 protruding from the mounting flange 44.

Although not shown, a stuffing box is preferably arranged about the outer shaft 34 at the interface with the support 38 to provide for a sealed pivoting of the coaxial shaft arrangement.

It may be noted that the mounting flange 44 with its centering member 48 and half-tubular extension 64 together with the parallel brackets 62, 62' may typically be manufactured in one piece, e.g. by casting from steel or cast iron. In this connection, the present lower sealing valve unit 10 is advantageous in that it requires only one such cast support 44 per pair of inlet valves. This reduces manufacturing costs, since only one cast support is required, also saving on machining/finishing of such cast iron piece and reducing problems of mounting and tolerances.

Figure 3:
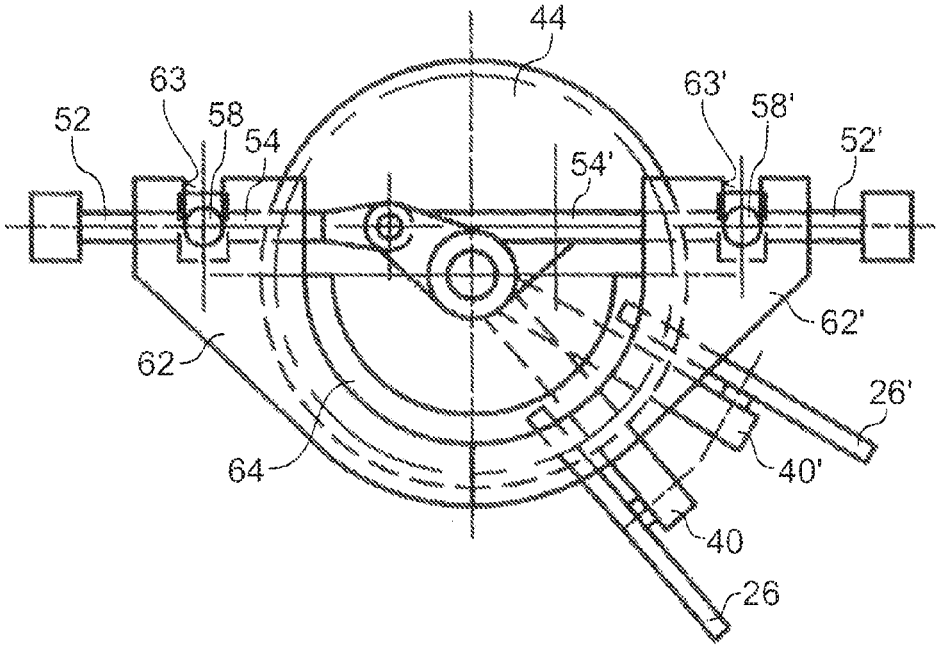
FIG. 3: is a side view of the valves and common support structure only, with one open valve.
Figure 4:
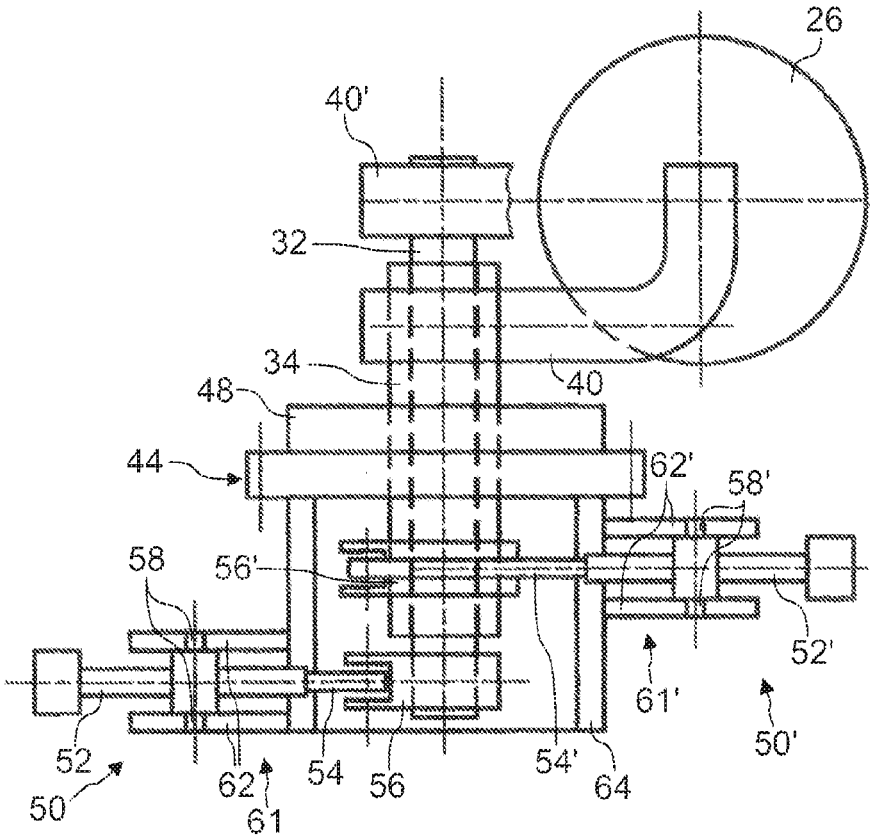
FIG. 4: is a top view of FIG. 3 (only the open valve being shown).

In FIGS. 3 and 4 (the housing 12 is not shown), flap 26 connected to the outer pivoting shaft 34 has been pivoted to an open position off the way of the charge material, the other flap 26' being in closed position (however not shown). Charge material may thus flow down from the associated hopper, at a rate defined by the respective material gate valve (not shown), through inlet 18, sleeve 30, and open valve 24 into the housing 12, and further below into the distribution device via outlet 22.

The invention claimed is:

1. A lower sealing valve unit for a charging system of a shaft furnace comprising:

a housing having a pair of inlets and at least one outlet;

a valve seat associated with each inlet;

a flap associated with each valve seat and adapted for, in a closed position, engaging said valve seat to sealingly close said inlet, each flap being supported by a pivotable shaft allowing displacement between said closed position and an open position off the associated valve seat;

wherein a common structure is mounted to one side of said housing, said common structure comprising a pair of drive mechanisms, each connected to one of said pivotable shafts for independent actuation, wherein each shaft is attached to a drive mechanism such that each drive mechanism independently pivots each flap, said shafts passing coaxially through said housing side and being supported by said common structure.

2. The lower sealing valve unit according to claim 1, wherein one of said pivotable shafts is hollow and the other one is concentrically arranged in said hollow shaft in such a way as to be freely rotatable.

3. The lower sealing valve unit according to claim 2, wherein said common structure comprises a mounting flange mounted to the outside of said housing and centered with respect to a corresponding opening therein, said mounting flange rotatably supporting said hollow shaft.

4. The lower sealing valve unit according to claim 3, wherein said mounting flange comprises a centering member having a cross-sectional shape matching the cross-section of said opening in said housing.

5. The lower sealing valve unit according to claim 3, wherein each drive mechanism comprises a linear actuator coupled to a respective shaft via a respective lever.

6. The lower sealing valve unit according to claim 1, wherein each flap is supported by an arm, which is connected to the respective pivotable shaft and rotationally integral therewith.

7. The lower sealing valve unit according to claim 1, wherein said valve seats are attached at the extremity of a respective sleeve projecting from each inlet inside said housing.

8. The lower sealing valve unit according to claim 1, wherein each drive mechanism comprises a linear actuator coupled to a respective shaft via a respective lever.

9. The lower sealing valve unit according to claim 8, wherein each linear actuator is pivotally supported by a respective cradle affixed to said mounting flange.

10. The lower sealing valve unit according to claim 9, wherein said cradle comprises a pair of parallel brackets fixed to an extension of said mounting flange, and said brackets being provided in their top edge with a vertical slot; and wherein the linear actuators are pivotally supported in said slots by means of trunnions provided at their periphery.

11. The lower sealing valve unit according to claim 10, wherein said mounting flange, said extension and said cradles are manufactured in one piece.

12. A top charging system for a shaft furnace comprising a set of two hoppers, each hopper having a material gate valve disposed at a lower end thereof and an upper sealing valve disposed at an upper end thereof; a distribution device below said hoppers for distributing charge material in said shaft furnace; and a lower sealing valve unit according to any one of the preceding claims that connects said hoppers to said distribution device via said material gate valves.

13. A shaft or blast furnace comprising a top charging system with a lower sealing valve unit according to claim 1.

* * * * *